United States Patent [19]

Martin et al.

[11] 4,174,719

[45] Nov. 20, 1979

Best Available Copy

[54] MICROPERFORATED FILTER TIP CIGARETTE

[75] Inventors: Richard H. Martin; William F. Owens, Jr., both of Pisgah Forest, N.C.

[73] Assignee: Olin Corporation, Pisgah Forest, N.C.

[21] Appl. No.: 811,046

[22] Filed: Jun. 29, 1977

[51] Int. Cl.[2] ..... A24B 15/02; A24D 1/04

[52] U.S. Cl. ..... 131/10 A; 131/11; 131/261 A

[58] Field of Search ..... 131/10 A, 11, 15 B, 131/10.3, 10 R, 261 R, 261 A; 93/1 C, 77 FT

[56] References Cited

U.S. PATENT DOCUMENTS

| | | | |
|---|---|---|---|
| 3,805,800 | 4/1974 | Summers | 131/10 A |
| 4,094,324 | 6/1978 | Bolsinger et al. | 131/10 A |

FOREIGN PATENT DOCUMENTS

| | | | |
|---|---|---|---|
| 2206663 | 6/1974 | France | 131/10 A |

*Primary Examiner*—V. Millin

*Attorney, Agent, or Firm*—Robert W. Habel

[57] ABSTRACT

An improved ventilated filter tip cigarette is provided utilizing a unique combination of porous filter plug wrap having a porosity of from about 300 to 4000 Filtrona air permeability units with a microperforated tipping envelope having perforations averaging less than about 0.01 $mm^2$ each in open area. The relationship of plug wrap porosity combined with the size of microperforations in the tipping envelope provide cigarettes with maximum selective reductions in carbon monoxide yields and only minor reductions in nicotine yields as compared to constituent yields heretofore obtained in the smoke from ventilated cigarettes.

6 Claims, 1 Drawing Figure

MICROPERFORATED FILTER TIP CIGARETTE

FIELD OF THE INVENTION

This invention relates generally to ventilated filter tip cigarettes and more particularly to ventilated cigarettes in which the tipping envelope enclosing the filter is microperforated.

BACKGROUND OF THE INVENTION

Ventilated cigarettes are well known in which a multiplicity of perforations are provided either in the tipping paper surrounding the filter or some portion of the cigarette itself. Typical examples of such cigarettes are disclosed in U.S. Pat. Nos. 2,988,088; 2,980,116; and 3,410,274. The perforations provide a means for diluting the smoke drawn through the cigarette with ambient air resulting in a cooler, less harsh-tasting cigarette. It is also recognized that air dilution reduces the delivery of total particulate matter and gas phase constituents in the smoke.

Air dilution or attenuation of the mainstream smoke of the cigarette through the filter tip has become the most popular and widely accepted method of reducing smoke yield constituents of cigarettes. With filter tip cigarettes having perforated tipping, the practice is to pattern the perforations in a circumferential line or lines about the tipping so that the holes are positioned either directly over the filter or at the junction between the filter and the tobacco column. When the perforations are disposed over the filter, the filter plug itself is wrapped in a porous, air permeable plug wrap thereby allowing air to enter the filter via the tipping perforations and porous plug wrap where it mixes with the smoke. In such cases, the tipping paper and plug wrap are adhered together over areas of their contiguous surfaces except in the perforated region, which is left adhesive-free to prevent blocking of both the tipping perforations and the porous plug wrap. The conventional means of accomplishing the air dilution effect with a perforated tipping envelope is through the use of macroperforated tipping having clearly visible, relatively large holes. Usually the holes are punched in the paper by mechanically perforating the tipping paper prior to constructing the cigarette, although electrostatically perforated tipping papers having randomly spaced holes of irregular size are disclosed in West German Offenlegungsschrift No. 25 31 285. Such mechanically perforated tipping papers exhibit a band of one or more lines in discrete perforations which are clearly visible to the unaided eye.

It is also known to utilize a uniformly porous tipping envelope overlying a porous filter plug wrap to achieve air ventilation of the mainstream smoke from cigarettes, as disclosed in U.S. Pat. No. 3,805,800. With such construction, the porous tipping envelope and plug wrap are glued together over areas of their contiguous surfaces with at least one ventilated region left unglued so as to provide a porous area for air to enter the mainstream smoke in the cigarette, thus providing the desired ventilation.

While the heretofore known ventilated cigarettes reduce the delivery of total particulate matter and gas phase constituents in the cigarette smoke, they do not provide the degree of selective reduction desired with regard to some of the more undesirable constituents in cigarette smoke, such as carbon monoxide. Moreover, they tend to reduce nicotine yields to a similar extent as other constituents such that at maximum total reductions achievable, the nicotine level in the smoke is drastically reduced. With increased public concern over the amount of carbon monoxide present in cigarette smoke, this constituent has become of increasing importance to the industry. This invention offers an alternate means to either macroperforated or ultraporous tipping for achieving air dilution at the filter while at the same time achieving heretofore unobtainable selective reductions of carbon monoxide without excessive reduction of nicotine in the cigarette smoke.

SUMMARY OF THE INVENTION

The structure of the ventilated cigarette according to the present invention comprises a filter wrapped with a porous, uniformly air permeable plug wrap enclosed in a microperforated tipping envelope having a zone of perforations disposed circumferentially around the tip of the cigarette, both the tipping envelope and plug wrap being adhered together by an adhesive over areas of their contiguous surfaces except in the zone of the tipping perforations. There are two critical elements of the invention, the combination of which produces the dramatic results achieved in the constituent yield of the mainstream smoke. First, the size of the microperforations in the tipping envelope must be such that each has an open hole area smaller than 0.01 $mm^2$, and second, the porosity of the uniformly air permeable plug wrap must be at least 300 Filtrona and no greater than 4000 Filtrona air permeability units. Surprisingly, it was found that when the foregoing two elements are incorporated in the structure of a filter cigarette, very selective reductions in carbon monoxide yield relative to other mainstream smoke constituents are achieved without equivalent reductions in nicotine yields.

As used herein, Filtrona air permeability means the volume of air that will flow through a specified area of paper per unit time at a constant pressure drop in accordance with the following equation:

Filtrona Air Permeability = cc of air/min/$cm^2$ paper/10 cm Water Gauge

Thus, a Filtrona air permeability of 3000 means that 3000 cubic centimeters of air will flow through a square centimeter section of paper in one minute at a back pressure of 10 centimeters Water Gauge.

DESCRIPTION OF PREFERRED EMBODIMENTS

Figure 1:
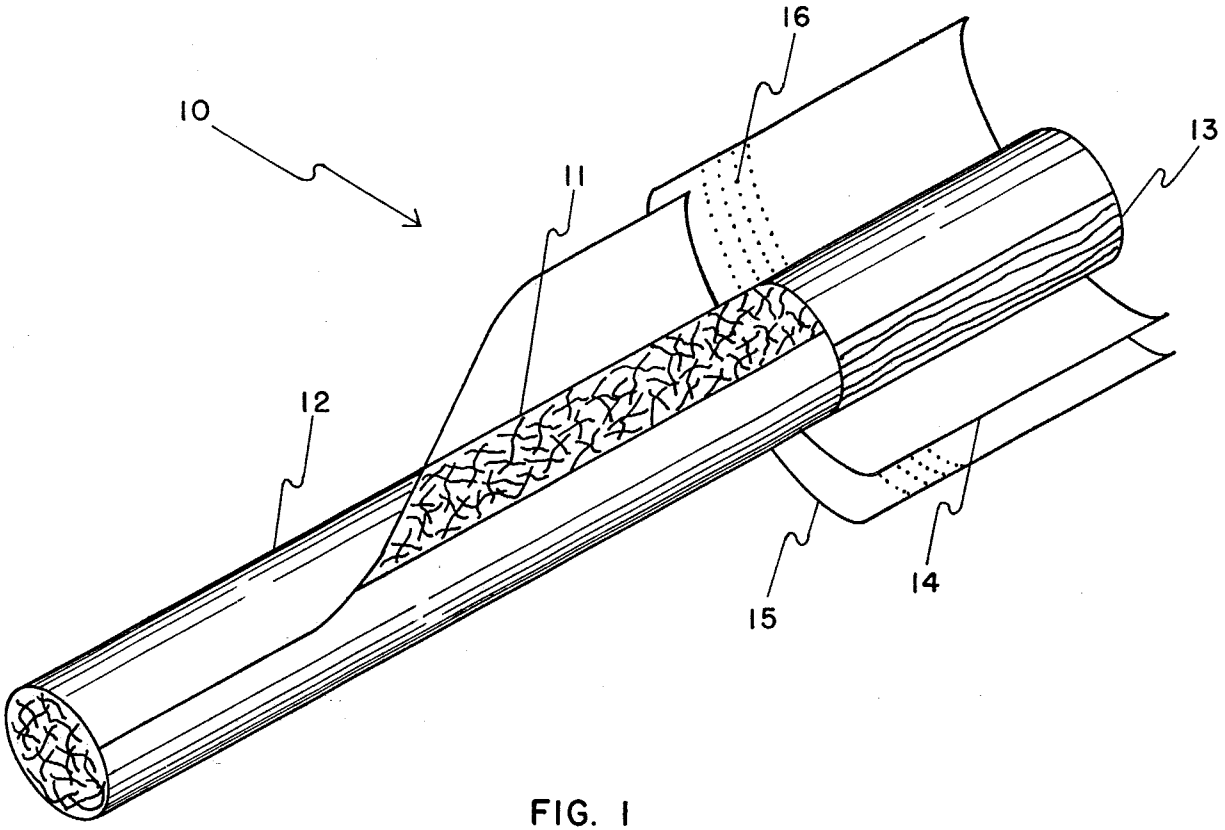
FIG. 1 is a perspective view of a cigarette constructed in accordance with the present invention.

FIG. 1 shows a cigarette generally designated 10 having a tobacco column 11 wrapped in conventional cigarette paper 12. Abutting the end of tobacco column 11 is a filter 13 which may comprise any commonly used cigarette filter media such as cellulose acetate fiber, paper, synthetic polymer foams, etc. Filter 13 is wrapped in uniformly porous plug wrap 14 and then enclosed in tipping envelope 15, a short section of which overlaps the cigarette paper 12 in order to affix the filter section to the cigarette paper surrounding the tobacco column. In accordance with the invention, tipping envelope 15 contains a multiplicity of minute perforations 16 in at least one zone or band of lines disposed circumferentially around the tip of the cigarette. The size of each perforation 16 is less than 0.1

$mm^2$ in open hole area and while they are depicted as dots in the drawing for purposes of illustration, holes of such micro size are invisible to the unaided eye. Perforated tippings with holes of such small and precise size have only recently been obtainable using electric spark discharge perforating techniques. Typical apparatus that may be used for producing such perforated tipping papers is disclosed in U.S. Pat. No. 4,029,938.

The other critical feature of the cigarette structure according to the invention is the air permeability of the uniformly porous plug wrap, which must be within the range of about 300 to 4000 Filtrona air permeability units. Thus, the combination of porous plug wrap having such air permeability with the microperforated tipping envelope produces the surprising maximum selective reductions in carbon monoxide yields in cigarettes constructed according to the invention. While heretofore it was known that air attenuated or ventilated systems have a tendency to reduce certain components more than others in cigarette smoke, it was not known until this discovery that the relationship between the hole size of the tipping perforations and air permeability of the plug wrap together were critical for maximum selectivity and that such a combination would achieve heretofore unobtainable selective reductions of carbon monoxide yields with only minimal reduction in nicotine yields. Use of the critical combination of tippings and plug wrap results in carbon monoxide reductions at least three times greater than nicotine reductions. Such relative reduction in carbon monoxide to nicotine is called the selectivity ratio defined herein as the percent reduction of carbon monoxide divided by the percent reduction of nicotine. In accordance with the invention, the selectivity ratio should be at least 3 and preferably 5 or greater. Selectivity ratios as high as about 12 have been achieved.

EXAMPLES

Tobacco columns of a commercial tobacco blend wrapped in conventional cigarette paper were cut to 7 mm lengths and weight selected to within ±2% of the average weight for the batch. The columns were tipped with 25 mm filter plugs of cellulose acetate tow separately wrapped in several uniformly porous plug wraps representative of the Filtrona air permeability values commercially available. Each wrapped filter plug was then attached to a tobacco column using microperforated tipping and the tipped cigarettes conditioned at 72° F. and 62% relative humidity prior to smoking. The perforated tippings employed were prepared on an electrostatic perforator which perforates the paper by high voltage discharge. The perforations were arranged in a single band of discrete lines, adjacent lines centered about 1 mm apart within the band and oriented around the circumference of the filter tip. The tipping was 30 mm wide with the band of perforations located approximately 10 mm from the tobacco column edge of the tipping. Two series of the perforated tippings were evaluated in combinaion with the various porous plug wraps, one series containing 4 lines of perforations per band and the other 10 lines of perforations per band, the open hole area of each perforation in both series being less than 0.01 $mm^2$. The perforated area in such tipping papers characteristically exhibits a porosity of 1000 to 1400 Filtrona air permeability units. The microperforated tipping and wrapped filter plugs were adhered together over areas of their contiguous surfaces except in the perforated zone which was left adhesive-free. The width of the adhesive-free area exceeded the perforation band width by 1 mm. Identical control cigarettes were prepared using the same tobacco column and cellulose acetate filter media except that the filter plug was wrapped in nonporous plug wrap and joined to the tobacco column by unperforated nonporous tipping with adhesive applied over the entire area of their contiguous surfaces.

Sample cigarettes from each series and the control were smoked on an automated smoking machine in accordance with FTC procedures with the smoke obtained in each puff collected and yields of the various smoke constituents determined by conventional methods. Reductions in various components were determined relative to the yields obtained from the control cigarettes which manifested no measurable air dilution or attenuation phenomena. The results are as follows:

TABLE I

| Tipping Lines of Perforations | Plug Wrap Filtrona Air Permeability | % Maximum Reductions CO | Tar | Nicotine | Selectivity Ratio CO/Nicotine |
|---|---|---|---|---|---|
| 4 | 340 | 40 | 25 | 5 | 8.00 |
| 4 | 1000 | 51 | 24 | 8 | 6.38 |
| 4 | 3000 | 71 | 30 | 6 | 11.83 |
| 4 | 21500 | 85 | 61 | 41 | 2.07 |
| 4 | 40000 | 92 | 62 | 33 | 2.79 |

TABLE II

| Tipping Lines of Perforations | Plug Wrap Filtrona Air Permeability | Selectivity % Maximum Reductions CO | Tar | Nicotine | Ratio CO/Nicotine |
|---|---|---|---|---|---|
| 10 | 340 | 63 | 28 | 7 | 9.00 |
| 10 | 1000 | 66 | 43 | 10 | 6.60 |
| 10 | 3000 | 90 | 46 | 17 | 5.29 |
| 10 | 21500 | 91 | 64 | 39 | 2.33 |
| 10 | 40000 | 95 | 63 | 45 | 2.11 |

As is evident from the above tables, in both the 4 lines per band and 10 lines per band series, reductions in carbon monoxide, dry tar and nicotine increase significantly with increasing porous plug wrap air permeability. However, both tipping series exhibit remarkable selective reductions of carbon monoxide and nominal reductions in nicotine at lower porous plug wrap air permeabilities. Thus in the first series, carbon monoxide is reduced 71% at a plug wrap air permeability of 3000 whereas nicotine is only reduced 6% resulting in a selectivity ratio of 11.83. Similarly, in the second series, carbon monoxide is reduced 90% at plug wrap air permeability of 3000 and nicotine only 17% for a selectivity ratio of 5.29. When plug wrap air permeability is 21,500 or greater, there is still some additional reduction in carbon monoxide except that nicotine reductions increase substantially and the selectivity ratio falls off to about 2.00. It will thus be seen that both tipping series demonstrate a dramatic and abrupt change in carbon monoxide selectivity between porous plug wrap air permeabilities of 3000 and 21,500 and that plug wrap air permeability of about 4000 is the maximum for achieving a selectivity ratio greater than 3. Unexpectedly, it was discovered that when microperforated tipping is employed with low and medium air permeability porous plug wrap, maximum carbon monoxide selectivity is achieved with only moderate nicotine reductions whereas high air permeability porous plug wraps provide little selectivity but maximum total component reductions.

Significant specific reductions in the carbon monoxide component of cigarette smoke can be achieved by an air dilution filter system fabricated from the various combinations of porous plug wrap and electrostatically microperforated tipping according to the present invention. Microperforated tipping in combination with medium to low air permeability porous plug wraps provide highly selective smoke component reductions with good precision that was heretofore unobtainable. Although the present invention has been described in conjunction with the preferred embodiments and examples, they are only illustrative of the invention and it is to be understood that many variations may be resorted to without departing from the spirit and scope of the invention, which those skilled in the art will readily understand.

What is claimed is:

1. A ventilated filter tip cigarette comprising in combination a filter enclosed by a uniformly porous wrapper having a Filtrona air permeability within the range of from 300 to 4000 units, a tipping envelope enclosing said enclosed filter containing a zone of microperforations, the size of each of said perforations being less than 0.01 $mm^2$ in open hole area, said wrapper and envelope adhered together over areas of their contiguous surfaces except in the area of the microperforations to permit ambient air to flow through the tipping perforations and porous wrapper, whereby the carbon monoxide yield in the smoke from the cigarette is selectively reduced over other smoke components resulting in a carbon monoxide to nicotine selectivity ratio of at least 3.

2. The ventilated filter tip cigarette of claim 1 in which the Filtrona air permeability of the porous wrapper is about 3000 units.

3. The ventilated filter tip cigarette of claim 1 in which the selectivity ratio is higher than 5.

4. The ventilated filter tip cigarette of claim 3 in which the area of the contiguous surfaces between the wrapper and envelope left adhesive-free exceeds the width of the band by at least 1 mm.

5. The ventilated filter tip cigarette of claim 1 in which the zone of microperforations in the tipping envelope comprises a band of adjacent discrete lines of perforations oriented around the circumference of the filter tip with said band of perforations spaced intermediate between the edges of the tipping envelope.

6. The ventilated filter tip cigarette of claim 5 in which the band comprises from 4 to 10 lines of perforations having a porosity of from 1000 to 1400 Filtrona air permeability units.

* * * * *